United States Patent [19]

Simmons

[11] Patent Number: 4,543,044

[45] Date of Patent: Sep. 24, 1985

[54] CONSTANT-FLOW-RATE DUAL-UNIT PUMP

[75] Inventor: Walter J. Simmons, Martinsburg, W. Va.

[73] Assignee: E. I. Du Pont de Nemours and Company, Wilmington, Del.

[21] Appl. No.: 550,186

[22] Filed: Nov. 9, 1983

[51] Int. Cl.[4] ..... F04B 35/02

[52] U.S. Cl. ..... 417/342; 417/346; 417/900

[58] Field of Search ..... 417/344, 345, 346, 900, 417/339, 342; 222/55, 57, 61, 278; 91/28

[56] References Cited

U.S. PATENT DOCUMENTS

| | | | |
|---|---|---|---|
| 2,866,415 | 12/1958 | Montelius | 417/345 |
| 3,201,031 | 8/1965 | Maglott | 417/339 |
| 3,234,882 | 2/1966 | Douglas et al. | 417/345 |
| 3,363,575 | 1/1968 | Potts | 417/344 |
| 3,667,869 | 6/1972 | Schlecht | 417/346 |
| 3,893,790 | 7/1975 | Mayer | 417/346 |
| 4,021,156 | 5/1977 | Fuchs, Jr. et al. | 417/346 |

FOREIGN PATENT DOCUMENTS

| | | | |
|---|---|---|---|
| 57-4450 | 1/1982 | Japan | 91/28 |
| WO83/01983 | 6/1983 | PCT Int'l Appl. | 417/900 |

*Primary Examiner*—Carlton R. Croyle
*Assistant Examiner*—Donald E. Stout

[57] ABSTRACT

A dual-unit pump, e.g., a rolling diaphragm piston pump, suitable for pumping an abrasive high-viscosity slurry, is adapted to operate at a constant flow rate by means for detecting and correcting a pressure differential in the two units before the units switch from the pumping cycle to the filling cycle and vice versa. The flow of liquids is controlled by valves of the type which switch the flow to and from the units with essentially no volume change in the liquid inlet and outlet lines.

6 Claims, 6 Drawing Figures

Legend For Figs 1-6

- High Pressure Delivery Liquid
- Low Pressure Delivery Liquid
- High-Pressure Working Liquid
- Low-Pressure Working Liquid
- * Open Valve
- ** Closed Valve

CONSTANT-FLOW-RATE DUAL-UNIT PUMP

BACKGROUND OF THE INVENTION

1. Field of the Invention

The present invention relates to pumps, and more particularly to pumps adapted to pump high-viscosity liquids and slurries.

2. Description of the Prior Art

Semi-solid colloidal dispersions of water-bearing blasting agents, e.g., water gels or slurry explosives or emulsion-type blasting agents, currently are available in the form of small-diameter cartridges. The cartridge, often referred to as a "chub" cartridge, is a tube of plastic film, filled with blasting agent, and gathered at both ends and closed, e.g., by means of metal closure bands around the gathered portions.

A machine which is capable of producing chub packages on a continuous basis is described in U.S. Pat. No. 2,831,302. The production of compartmented chub packages, such as those which are used in resin-anchored rock bolt mine-roof-support systems, is described in U.S. Pat. No. 3,795,801. These packaging machines, known as "form/fill" machines, continuously form a web of film into a single- or double-compartment tube and simultaneously fill the tube with product. They also constrict the tube at spaced intervals and apply the closure bands to each constricted area.

The capability of the pump used to deliver the product into the tube critically affects the packaging results. It goes without saying that the pump must provide accurate metering. In this instance, it must also be well-suited to the handling of high-viscosity (e.g., 10,000 to 5,000,000 cp), often abrasive, slurries. Beyond these requirements, however, is the important consideration of uniformity of flow rate. Because the tube-forming, filling, and closing operations have to be performed in proper synchrony, the flow rate of the product being pumped must be constant and equal to the rate at which the tube is formed and moves through the packaging machine. This produces a firm, usable package. If the pumping rate drops periodically, the resulting packages may be underfilled and limp. On the other hand, if the pumping rate is excessive, the packages may break. Deviations in flow rate as small as 1–2% can create difficulties in package use.

A constant flow rate of pumped product is important in pumping many types of products in addition to water-bearing explosives and roof bolt anchoring compositions. These include food products, concrete, fraccing fluids for oil and gas wells, coal/water slurries, nuclear waste slurries, asphalt, paint, and filled epoxy resins.

Many pumps are available which have a good metering capability. These include gear pumps, piston pumps, and screw pumps. However, pumps such as these generally do not handle slurries well, particularly when they are high in viscosity and abrasive. Moreover, the known diaphragm pumps that will handle slurries all suffer from one drawback: they do not provide a fully constant flow rate.

For example, the pump described in U.S. Pat. No. 2,419,993 includes two chambers, each having a flexible diaphragm separating it into two compartments containing the delivery fluid (fluid to be pumped) and the driving fluid. However, because of the simultaneous switching of the valves in the driving fluid lines, the compressibility of the fluids, the expansion of the housings, and the movement of the check valves used, the flow of delivery fluid at changeover from one diaphragm to the other is pulsating. Thus, two pulses in flow occur during each cycle. Likewise, in the diaphragm pump described in U.S. Pat. No. 3,646,000, which employs four diaphragms, a pressure pulse is created when each pair of diaphragms reverses direction. This, coupled with the action of check valves, causes a pulsating flow.

The twin-diaphragm pump shown in U.S. Pat. No. 2,667,129 also is incapable of providing a constant flow rate owing to its check valves and the mechanical linkage of the diaphragms. The pumping ceases momentarily when the direction of motion is reversed. The diaphragm-type mud pump of U.S. Pat. No. 2,703,055 also has no constant-flow capability because of the check valves, the compressibilty of the fluids, the expansion of the housings, and the simultaneous switching from one housing to the other. The change in internal volume in the switching of the valves in the pump described in U.S. Pat. No. 3,320,901 prevents a constant flow rate from being achieved on switching from one cylinder to another.

Other patents on slurry pumps that also exhibit one or more of the above deficiencies include U.S. Pat. Nos. 3,637,328, 3,951,572, and 4,321,016.

The pulsating flow problem encountered in the above-described pumps could be reduced by using three or more pumping chambers, but this would entail great complexity and expense. Moreover, the valves used in these pumps are usually stated to be check valves, which require reverse fluid flow to close and which extract energy from the fluid, thus changing the flow rate momentarily. Furthermore, the flow rate drops during the changeover from one chamber to another due to the compressibility of the fluid and the expansion of the diaphragm housing. This drop in flow rate can be substantial, particularly if the slurry being pumped contains entrained air (as can be the case with slurry explosives) or if the pressures are very high.

SUMMARY OF THE INVENTION

The present invention provides an improvement in a dual-unit pump (e.g., a rolling diaphragm piston pump) in which each unit has a housing divided by a sealing means (e.g., a slidable piston and attached rolling diaphragm) into a variable-volume working (driving) liquid chamber and a complementary variable-volume delivery liquid (product) chamber, and wherein the discharge of product is alternately switched from one housing to the other. The improvement of the invention comprises (a) means for controlling the flow of liquids to and from the chambers in a manner such that delivery liquid is admitted to one of the housings, and working liquid discharged therefrom (filling cycle), while working liquid is being admitted to, and delivery liquid discharged from, the other (discharge cycle) at rates such that the filling cycle in one housing is completed before the discharge cycle is completed in the other, the flow control means being adapted to be activated so as to alternately switch the flow of delivery and working liquids to and from the housings from one housing to the other with essentially no volume change in the liquid inlet and outlet lines;

(b) sensing means, e.g., a differential pressure valve, for detecting a liquid pressure differential in the two housings at the end of the filling cycle; and (c) means for equalizing the liquid pressure in the two housings activated in response to a pressure differential detected by the sensing means, the equalizing means being adapted to complete the pressure equalization before the liquid flow control means are activated to switch the flow of delivery and working liquids to and from the housings from one housing to the other, whereby the switch is accomplished with no change in flow rate.

The present pump comprises:

(a) two pumping units, e.g., pressure vessels, that are adapted to function cooperatively, each of these units comprising (1) a housing adapted to confine a working (or driving) liquid, e.g., oil or water, and a product liquid or slurry to be pumped, e.g., a solids-laden resin formulation such as that described in U.S. Pat. No. 4,280,943, used to anchor a reinforcing bolt in a hole in a mine roof; (2) sealing means adapted to divide the housing into a variable-volume working-liquid chamber and a complementary variable-volume delivery-liquid chamber, e.g.,. a piston slidably mounted in the housing and a rolling diaphragm peripherally attached to the housing and centrally attached to the piston head so as to form a flexible, frictionless seal between the working and delivery liquids; (3) ports in the housing for admitting working liquid to, and discharging working liquid from, the working-liquid chamber; and (4) ports in the housing for admitting delivery liquid to, and discharging delivery liquid from, the delivery-liquid chamber;

(b) a primary working-liquid inlet line communicating with (1) a port in each housing, (2) a source of working liquid, e.g., a reservoir, and (3) a means of driving the working liquid from the reservoir through the inlet line at a constant flow rate;

(c) a secondary working-liquid inlet line communicating with a port in each housing and with a source of working liquid, e.g., the same reservoir which communicates with the primary working-liquid inlet line;

(d) a working-liquid outlet line communicating with a port in each housing;

(e) delivery-liquid inlet and outlet lines communicating with ports in each housing;

(f) means, e.g., ball, plug, or rotary shear seal valves, in the working-liquid and delivery-liquid inlet and outlet lines for controlling the flow of liquids to and from the chambers in a manner such that delivery liquid is admitted to one of the housings, and working liquid discharged therefrom (filling cycle), while working liquid is being admitted to, and delivery liquid discharged from, the other (discharge cycle) at rates such that the filling cycle in one housing is completed before the discharge cycle is completed in the other, the flow control means being adapted to be activated so as to alternately switch the flow of delivery and working liquids to and from the housings from one housing to the other with essentially no volume change in the liquid inlet and outlet lines;

(g) sensing means in the working-liquid inlet lines for detecting a liquid pressure differential in the two housings at the end of the filling cycle; and (h) means, e.g., a valve, in the secondary working-liquid inlet line, for equalizing the liquid pressure in the two housings and activated in response to the detection of a pressure differential by the sensing means, the equalizing means being adapted to complete the pressure equalization before the liquid flow control means are activated to switch the flow of delivery and working liquids to and from the housings from one housing to the other.

In a preferred embodiment, the pump is a diaphragm piston pump and the diaphragm in each housing is a rolling-seal diaphragm peripherally attached to the housing and centrally attached to the piston head so as to form a flexible, frictionless seal, thereby adapting the pump for use with abrasive slurries.

BRIEF DESCRIPTION OF THE DRAWING

In the accompanying drawing.

DETAILED DESCRIPTION

Figure 1:
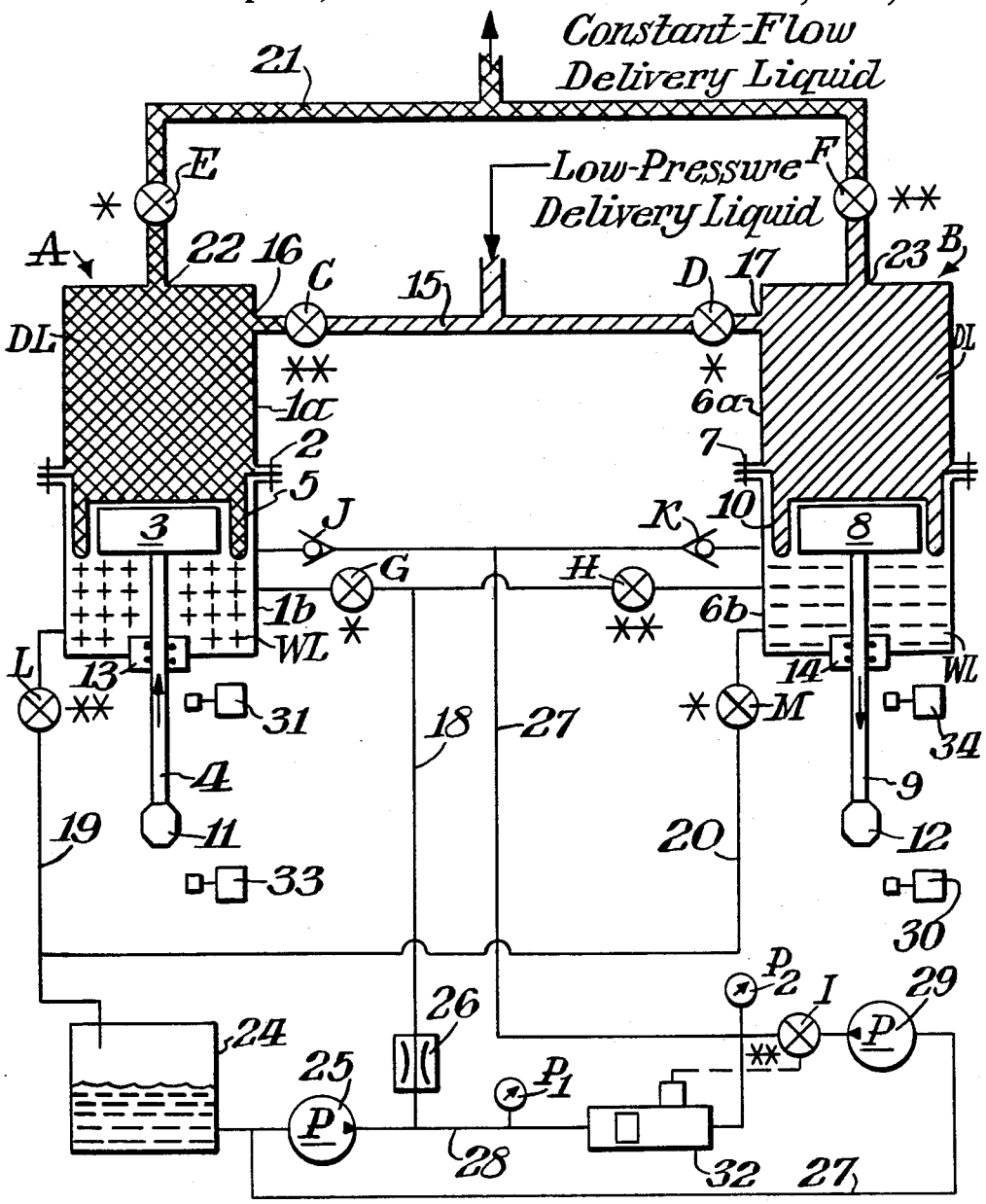
FIGS. 1 through 6 are schematic representations of a pump of the invention showing the positions and settings of its various components in a full sequence of operations starting with a first unit in the delivery-liquid discharging mode (FIGS. 1, 2, and 3), preparation for switch-over to the second unit (FIGS. 2 and 3), the second unit in the delivery-liquid discharging mode (FIGS. 4, 5 and 6), and preparation for the switch back to the first unit for discharging delivery-liquid (FIGS. 5 and 6).

In FIG. 1, a first pumping unit, designated A, consists of a cylindrical metal housing formed in two parts 1*a* and 1*b*, which are held together by a clamp 2. A piston having a head 3 and a rod 4 is slidably mounted in the housing. A rolling diaphragm of the type described in U.S. Pat. Nos. 3,137,215, and 3,373,236, and in the brochure D-211-5, Design Manual 5/78/10M published by the Bellofram Corporation, is denoted by the numeral 5. Diaphragm 5 is made of a material which is essentially a layer of specially woven fabric, impregnated with a thin layer of elastomer. The material is formed in the shape of a top hat, the outer flange of which is clamped to the housing at 2 between parts 1*a* and 1 *b*, and the center of which is fastened to piston head 3 in any convenient manner (not shown). Diaphragm 5 is turned on itself when installed so that, during the stroke of the piston, it rolls and unrolls alternately on the piston skirt and the housing wall.

The pump also contains a second pumping unit, designated B, structured exactly like unit A, components 6*a*, 6*b*, 7, 8, 9, and 10 in unit B corresponding to components 1*a*, 1*b*, 2, 3, 4, and 5, respectively, in unit A. Attached to rods 4 and 9 are activators 11 and 12, respectively, which provide for position monitoring of diaphragms 5 and 10, respectively. Seals 13 and 14 prevent liquid from leaking around rods 4 and 9, respectively.

Diaphragms 5 and 10 form a flexible, frictionless seal between the delivery liquid DL (product to be pumped) and the working liquid WL and thereby divide the housing into a piston-containing variable-volume working-liquid chamber and a complementary variable-volume delivery-liquid chamber. Delivery liquid is admitted to units A and B at low pressure, e.g., about 135–450 kPa, through a common inlet line 15 which communicates with delivery-liquid inlet ports 16 and 17 in housing sections 1*a* and 6*a*, respectively. In the drawing, DL denoted by obliquely oriented parallel lines is low-pressure DL, while DL denoted by a set of parallel lines at right angles to another set of parallel lines is high-pressure DL. WL indicated by horizontal parallel dotted lines is low-pressure WL, and WL denoted by horizontally aligned plus signs is high-pressure WL.

Line 15 is provided with a pair of valves C and D, which are the means for controlling the flow of DL to the DL chambers. Valves C and D are of a type which cause no volume change on opening or closing, e.g., ball valves, plug valves, shear seal valves or the like. In the first stage, shown in FIG. 1, valve C is closed and valve D open. Delivery liquid, e.g., a slurry, may be delivered into line 15 when required by a pulsating diaphragm pump such as a Wilden pump or the like. Delivery liquid is discharged from units A and B through a DL outlet line 21 which communicates with DL outlet ports 22 and 23 in housing sections 1*a* and 6*a*, respectively. Line 21 is provided with a pair of valves E and F, of a type which causes no volume change on opening or closing. In the first stage, valve E is open and valve F closed. Valves in the open position are marked *, while closed valves are marked **.

Working liquid is admitted to units A and B through a common primary working-liquid inlet line 18 which communicates with primary working-liquid inlet ports in housing sections 1*b* and 6*b*, respectively. Line 18 is provided with a pair of valves G and H, of one of the types useful as valves C, D, E, and F. In the first stage, valve G is open and valve H closed. Working liquid is discharged from units A and B through working-liquid outlet lines 19 and 20, each of which communicates with a working-liquid outlet port in housing section 1*b* and 6*b*, respectively. Lines 19 and 20 are provided with valves L and M, respectively. In Stage 1, valve L is closed and valve M open.

Working-liquid inlet line 18 and outlet lines 19 and 20 communicate with a working-liquid reservoir 24. Constant delivery pump 25 pumps liquid from reservoir 24 into line 18, through flow meter 26 and into housing section 1*b* or 6*b*, or both, depending on the position of valves G and H.

The pump of this invention has a secondary working-liquid inlet line 27, which communicates with secondary working-liquid inlet ports in housing sections 1*b* and 6*b*, respectively, and also with reservoir 24. Line 27 is provided with a pair of check valves J and K. Line 27 draws working liquid from line 18 as shown and is pumped to housing sections 1*b* and/or 6*b* by variable delivery pump 29 intermittently as required. The activation of pump 29 will be described below.

In Stage 1 (FIG. 1), pumping unit A is in its pumping or discharge cycle while unit B is in its filling cycle. Valves E, G, D, and M being open, and valves F, H, C, and L closed, working liquid is being pumped (by pump 25) into housing section 1*b*. By moving piston 3,4 and diaphragm 5, high-pressure working liquid WL displaces delivery liquid DL, which flows into line 21 at a rate that is substantially equal to the rate at which working liquid flows through line 18. The pressures of WL and DL also are about equal. As diaphragm 5 moves up, low-pressure delivery liquid (provided, for example, by a pulsating diaphragm pump) flowing in line 15 enters housing section 6*a* and pushes diaphragm 10 down, forcing working liquid into outlet line 20 and back to reservoir 24. The feed rate of the low-pressure delivery liquid is adjusted so that diaphragm 10 and piston 8,9 will reach the bottom of their stroke before diaphragm 5 and piston 3,4 reach the top of their stroke. The reason for this is to allow time for pressure equalization to occur, as will now be explained.

In Stage 2 (FIG. 2), the filling cycle is past completion, diaphragm 10 and piston 8,9 having reached the bottom of their stroke, as indicated by the position of activator 12. Limit switch 30, which has been activated by activator 12 (a cam), has caused the closure of valves M and D and the start of pump 29. Valves M and D can be, for example, air or electrically operated ball or plug valves. Pump 29 may be an air-operated piston pump or any other pump that is suitable for pumping small quantities of working liquid at a pressure equal to that supplied by pump 25. Unlike pump 25, however, pump 29 may have pulsating flow since its only function is to equalize the pressures. Liquid pressure indicators $P_1$ and $P_2$, inserted in line 28, a branch-off of line 18, and in line 27, communicate with differential pressure valve 32, e.g., a floating piston device with magnetic sensor or any other device for determining when pressures are equal to one another. In stage 2, $P_1$ and $P_2$ have been found to be unequal, e.g., $P_1$ is greater than $P_2$. This condition, encountered when limit valve 30 has been activated, causes valve I to open and valve pump 29 to supply working liquid through check valve K to housing section 6*b*. Check valve J is closed. When $P_2$ equals $P_1$, differential pressure valve 32 closes valve I and shuts off pump 29. (Note: if ball valves were to be substituted for check valves J and K, valve K would open upon activation of limit valve 30.)

Figure 2:
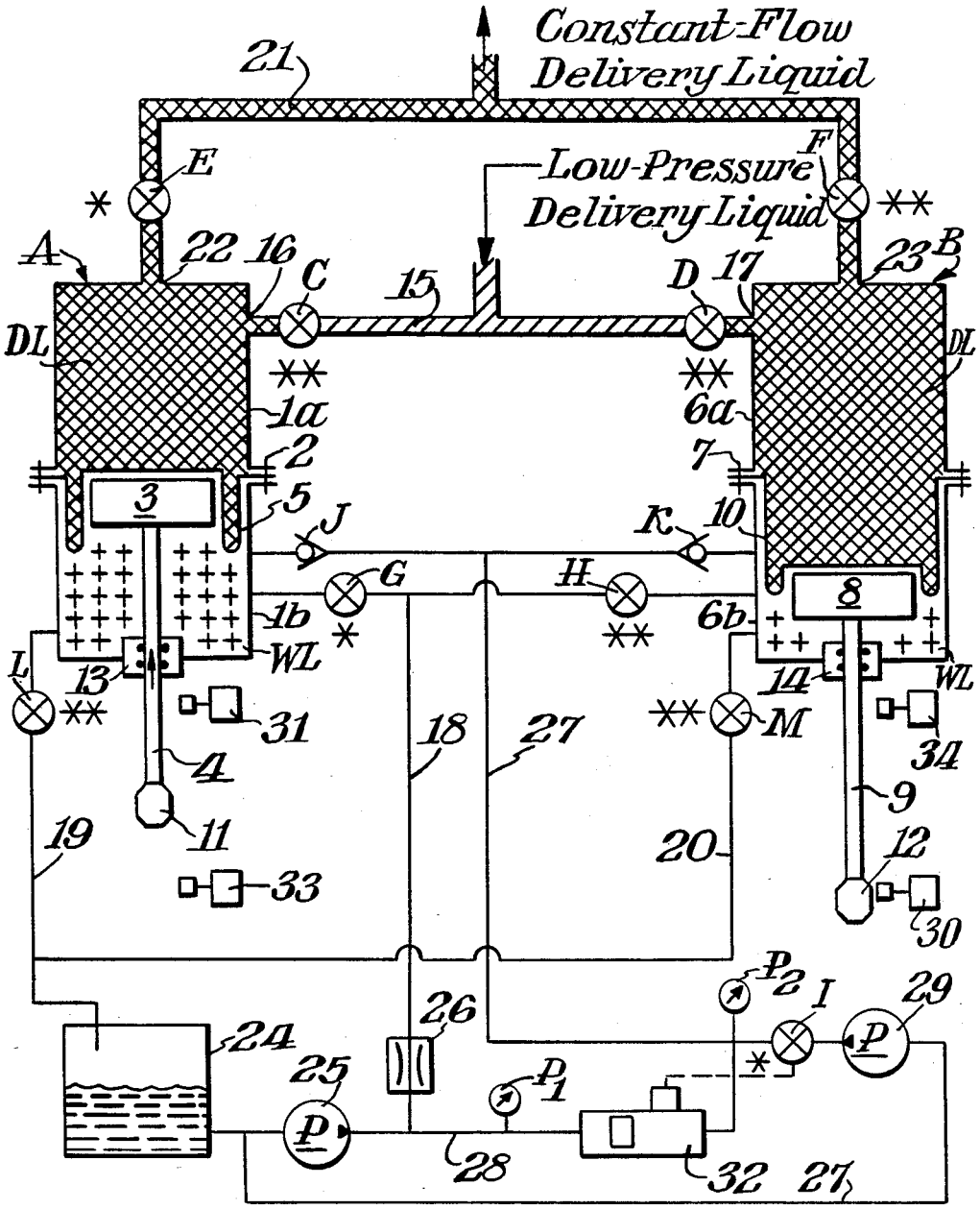

At the point shown in FIG. 2, piston 3,4 is still travelling upward and the housing in unit B has been pressurized to equal the pressure in the housing in unit A. Unit B now waits for unit A to reach the top of its stroke.

In Stage 3 (FIG. 3), diaphragm 5 has almost reached the limit of its stroke, and cam 11 has activated limit valve 31 to start the following sequence:

(1) Valve H opens. No working liquid flows through valve H into housing section 6*b* at this point because the pressures in both units have been equalized.

(2) Valve F opens. No slurry flows out of unit B at this point because the pressures are equal.

Figure 3:
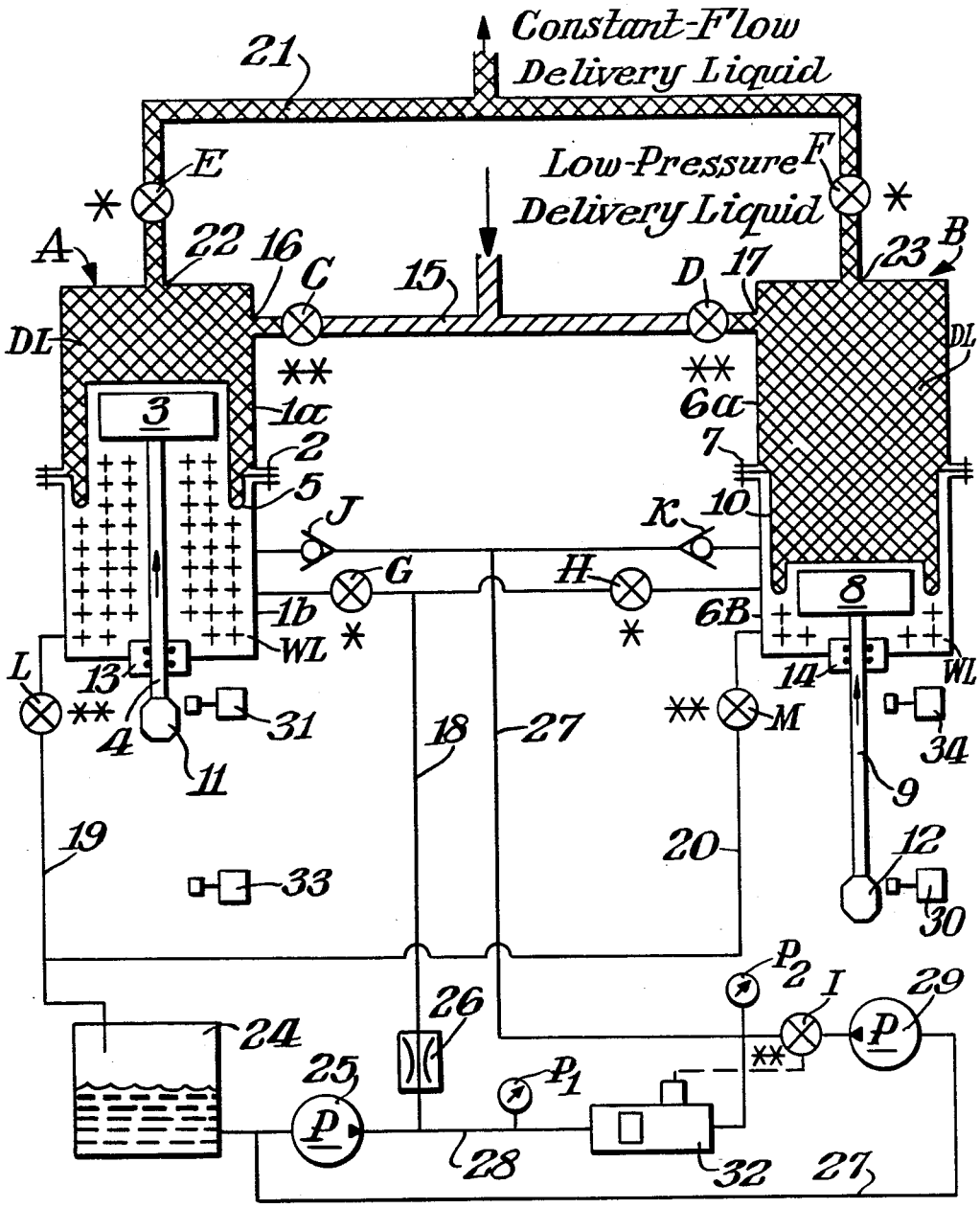

(3) Valve E closes (FIG. 4) after valve F has opened. Note that while valve E is closing, the flow of DL is gradually shifted from unit A to unit B and that for a short period of time (about one second) both units are actually discharging delivery liquid (FIG. 3). The delivery rate of DL from both units is constant, however, since the discharge rate must always be equal to the flow rate of the working liquid supplied by pump 25, and this rate is constant.

Figure 4:
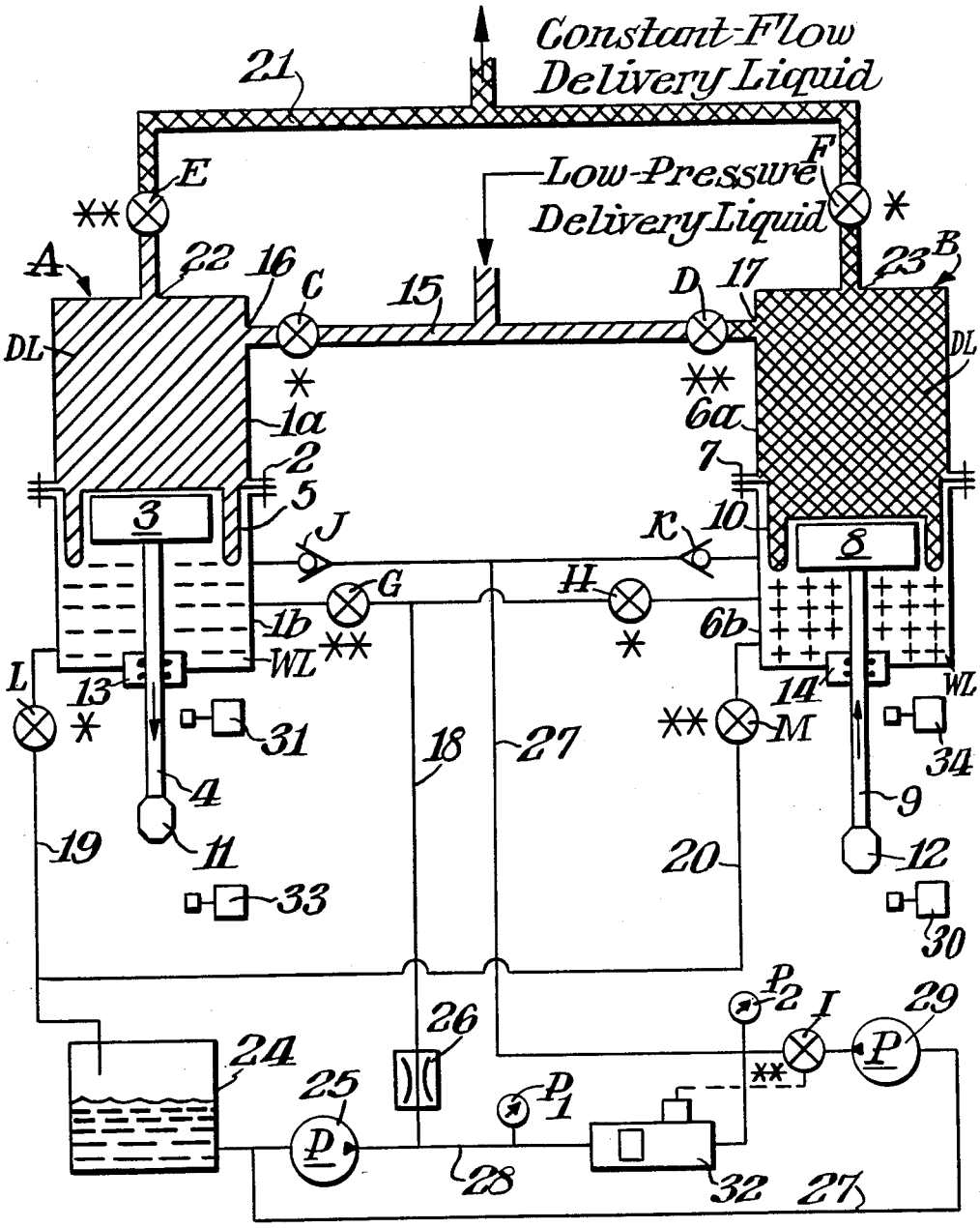

(4) Valve G closes after valve E is closed (FIG. 4).

(5) Valve L opens only after valve G is fully closed (FIG. 4).

(6) Valve C opens (FIG. 4) and low-pressure delivery liquid flows into housing section 1*a* through line 15.

The result of the above sequence is Stage 4, shown in FIG. 4, wherein unit B is supplying constant-flow-rate delivery liquid and unit A is being filled. Valves F, H, C, and L are open, and valves E, G, D, and M are closed.

Figure 5:
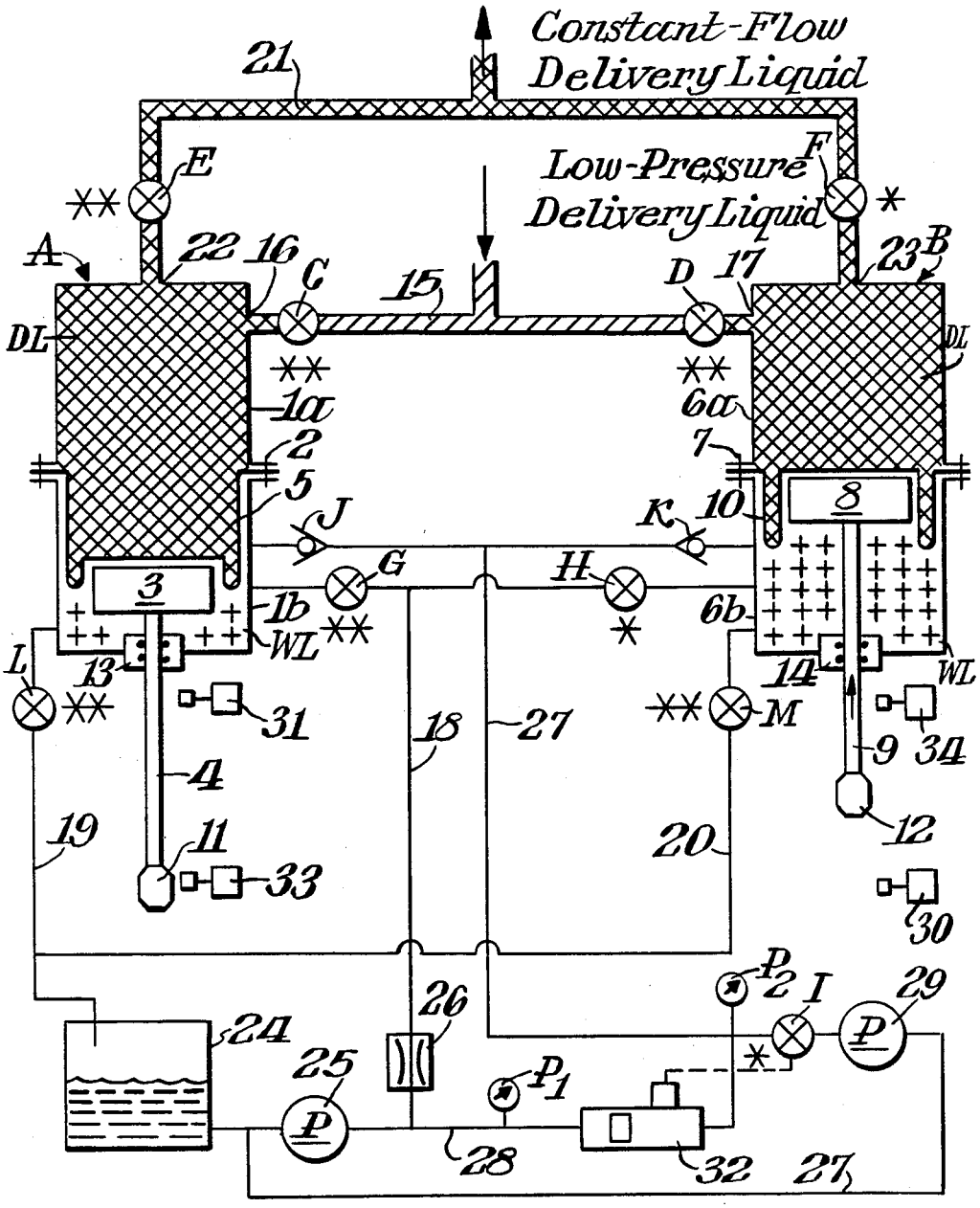

In Stage 5 (FIG. 5), which is comparable to Stage 2 with the operations of the units reversed, the filling cycle in unit A is past completion, diaphragm 5 and piston 3,4 having reached the bottom of their stroke, as indicated by the position of activator 11. Limit valve 33, which has been activated by activator 11 (a cam), has caused the closure of valves L and C (stopping working liquid from leaving unit A and stopping delivery liquid flow into housing section 1*b*) and the start of pump 29. Valve I has opened, and pump 29 has supplied working liquid through check valve J to housing section 1*b*. Check valve K is closed. When $P_1$ equals $P_2$, differential pressure valve 32 closes valve I and shuts off pump 29. At the point shown in FIG. 5, piston 8,9 is still travelling upward and the housing in unit A has been pressurized to equal the pressure in the housing in unit B. Unit A now waits for unit B to reach the top of its stroke.

In Stage 6 (FIG. 6), diaphragm 10 has almost reached the limit of its stroke, and cam 12 has activated limit valve 34 to start the following sequence:

(1) Valve G opens. No working liquid flows into housing section 1*b* because the pressures in both units have been equalized.

(2) Valve E opens. No delivery liquid flows out of unit A because the pressures are equal.

Figure 6:
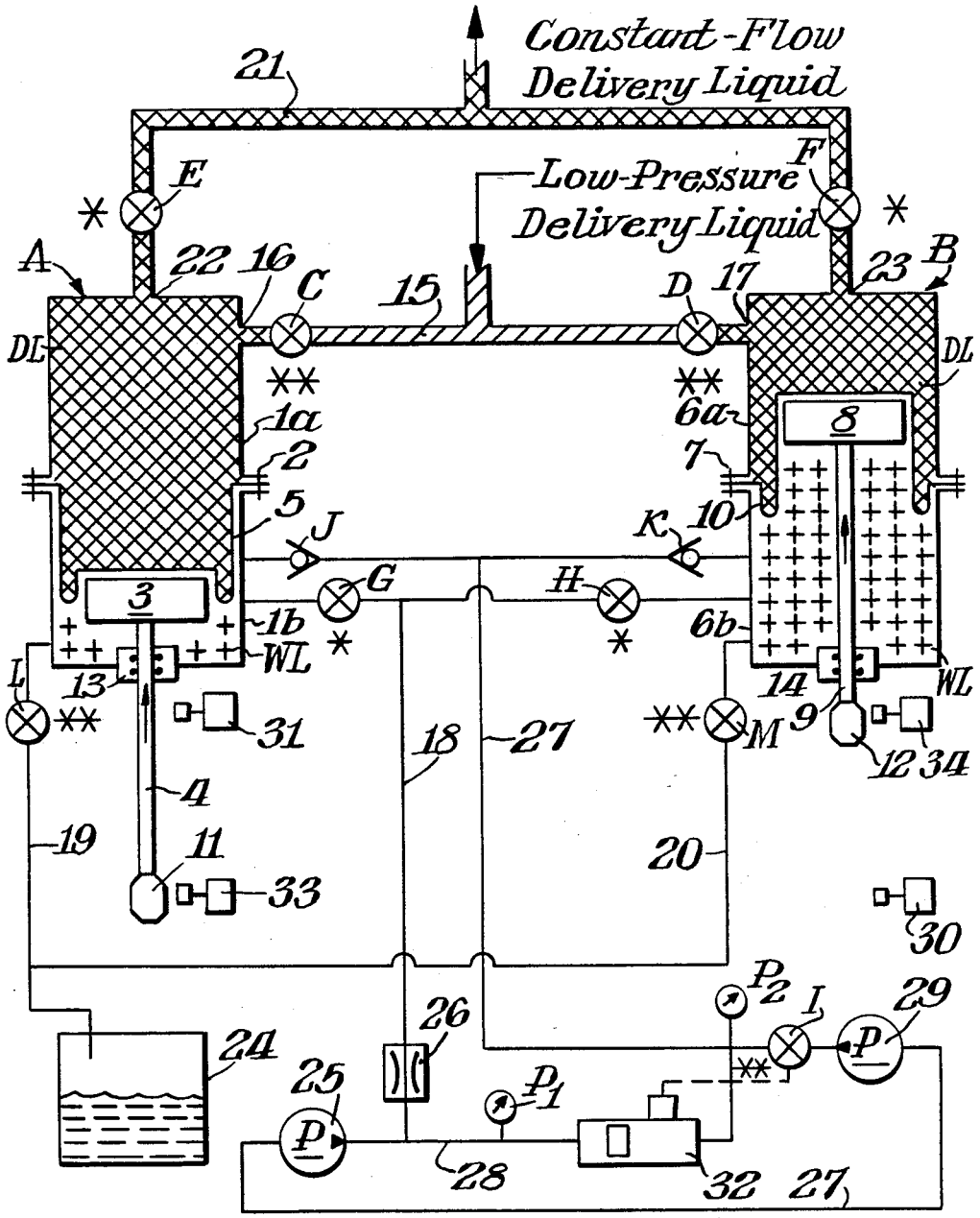

(3) Valve F closes (FIG. 1) after valve E has opened. Note that while valve F is closing, the flow of delivery liquid is gradually shifted from unit B to unit A and that for a short period of time (about one second) both units are actually discharging delivery liquid (FIG. 6). The delivery rate of DL from both units is constant, however, since the discharge rate must always be equal to the flow rate of the working liquid supplied by pump 25, and this rate is constant.

(4) Valve H closes after valve F is closed (FIG. 1).

(5) Valve M opens only after valve H is fully closed (FIG. 1).

(6) Valve D opens (FIG. 1) and low-pressure delivery liquid flows into housing section 6*a* through line 15.

The result of the above sequence is Stage 1, shown in FIG. 1, wherein unit A is supplying constant-flow-rate delivery liquid and unit B is being filled.

As is shown by the foregoing description, in the present pump, a constant flow rate is provided by delivering a working liquid by a constant-delivery pump alternately to two housing units, and equalizing the pressures in the two units before the pumping cycle is switched from one unit to the other. An energy source outside of the working liquid itself, e.g., a pump in an auxiliary or secondary working liquid line, is used to equalize the pressure. This compensates for the compressibility of the liquid being pumped and the elasticity of the housing. The valves used to control liquid flow are of the type which do not change volume when activated, and the sequence of valve operation is such that constant flow rate is maintained. The differential pressure across the valves is always approximately zero during closing or opening, except for the valves in the working-liquid outlet lines.

The term "delivery liquid" as used herein to describe the product which is pumped by the pump of this invention denotes totally liquid materials of wide range of viscosity, e.g., 1 to 5,000,000 centipoise, when the pump is of the diaphragm type, as well as solids-laden liquids, e.g., slurries. The "delivery liquid" may also be an abrasive slurry, in which case each unit preferably is a rolling-seal-diaphragm piston pump.

I claim:

1. In a dual-unit pump for pumping a high-viscosity slurry wherein each unit has a housing divided by a sealing means into a variable-volume working-liquid chamber and a complementary variable-volume delivery-liquid (product) chamber, wherein product is discharged from one of said units while the other unit is being filled with product, wherein the discharge of product is alternately switched from one of said units to the other, and wherein said sealing means comprises a piston slidably mounted in said housing and a rolling diaphragm peripherally attached to said housing and centrally attached to the piston head so as to form a flexible, frictionless seal between said working and delivery liquids, the improvement comprising (a) means for controlling the flow of liquids to and from said chambers in a manner such that delivery liquid is admitted to one of said housings, and working liquid discharged therefrom (filling cycle), while working liquid is being admitted to, and delivery liquid discharged from, the other (discharge cycle) at rates such that the filling cycle in one of said housings is completed before the discharge cycle is completed in the other, said flow control means being adapted to be activated so as to alternately switch the flow of delivery and working liquids to and from said housings from one housing to the other with essentially no volume change in the liquid flow lines;

(b) sensing means for detecting a liquid pressure differential in said two housings at the end of the filling cycle; and (c) means for equalizing the liquid pressure in said two housings, said pressure-equalizing means (1) deriving its energy from a source which is independent of the source from which the energy for admitting said working liquid to said housings is derived, (2) being activated in response to the detection of a pressure differential by said sensing means, and (3) being adapted to complete the pressure equalization before the liquid flow control means are activated to switch the flow of delivery and working liquids to and from said housings from one housing to the other.

2. A pump for pumping a high viscosity-slurry comprising (a) two pumping units that are adapted to function cooperatively, each of said units comprising (1) a housing adapted to confine a working liquid and a delivery (product) liquid to be pumped; (2) sealing means adapted to divide said housing into a variable-volume working-liquid chamber and a complementary variable-volume delivery-liquid chamber, said sealing means comprising a piston slidably mounted in said housing and a rolling diaphragm peripherally attached to said housing and centrally attached to the piston head so as to form a flexible, frictionless seal between said working and delivery liquids; (3) ports in said housing for admitting working liquid to, and discharging working liquid from, said working-liquid chamber; and (4) ports in said housing for admitting delivery liquid to, and discharging delivery liquid from, said delivery-liquid chamber;

(b) a primary working-liquid inlet line communicating with (1) a port in each housing (2) a source of working liquid, and (3) a means of driving said working liquid from said source through said primary inlet line and into said working-liquid chamber at a constant flow rate;

(c) a secondary working-liquid inlet line communicating with (1) a port in each housing, (2) a source of working liquid, and (3) a means of driving said working liquid from said source through said secondary inlet line and into said working-liquid chamber;

(d) a working-liquid outlet line communicating with a port in each housing;

(e) delivery-liquid inlet and outlet lines communicating with ports in each housing;

(f) means in said working-liquid and delivery-liquid inlet and outlet lines for controlling the flow of liquids to and from said chambers in a manner such that delivery liquid is admitted to one of said housings, and working liquid discharged therefrom (filling cycle), while working liquid is being admitted to, and delivery liquid discharged from, the other (discharge cycle) at rates such that the filling cycle in one housing is completed before the discharge cycle is completed in the other, said flow control means being adapted to be activated so as to alternately switch the flow of delivery and working liquids to and from said housings from one housing to another with essentially no volume change in the liquid inlet and outlet lines;

(g) sensing means in said working-liquid inlet lines for detecting a liquid pressure differential in said two housings at the end of the filling cycle; and (h) means for equalizing the liquid pressure in said two housings activated in response to the detection of a pressure differential by said sensing means, said equalizing means being adapted to complete the pressure equalization before said liquid flow control means are activated to switch the flow of delivery and working liquids to and from the housings from one housing to the other.

3. A pump of claim 2 wherein said flow control means comprise (a) a pair of valves (G, H) in said primary working-liquid inlet line adapted to permit the flow of working liquid to said housings when open and prevent said flow when closed; (b) a pair of valves (L, M) in said working-liquid outlet lines adapted to permit the discharge of working liquid from said housings when open and prevent said discharge when closed; (c) a pair of valves (C, D) in said delivery-liquid inlet line adapted to permit the flow of delivery liquid to said housings when open and prevent said flow when closed; and (d) a pair of valves (E, F) in said delivery-liquid outlet line adapted to permit the discharge of delivery liquid from said housings when open and prevent said discharge when closed; valves G, L, C, and E controlling the flow to and from one of said units, and valves H, M, D, and F controlling the flow to and from the other; valves G and E being open and L and C closed during the units's discharge cycle while valves H and F are closed and M and D open during the other unit's simultaneous filling cycle, valve openings and closures being reversed when the cycles switch from one unit to the other.

4. A pump of claim 3 wherein said secondary working-liquid inlet line communicates with a pressure-equalizing pump and an associated valve (I) which opens to admit working liquid from the pressure-equalizing pump into said secondary inlet line when a pressure differential in said housings has been detected by said sensing means positioned across both said primary and secondary working-liquid lines, said secondary working-liquid inlet line being provided with a pair of valves (J, K) adapted to admit working liquid to one or both of said housings to equalize the pressures therein before the discharge cycle is switched over from one unit to the other.

5. A pump of claim 4 adapted to perform the following valve sequencing repetitively;

(a) valves G, E, D and M being open and H, F, C, L and I closed as one unit (A) is discharging and the other (B) filling, valves M and D are adapted to close, and the pressure-equalizing pump is adapted to be activated, at the completion of the filling cycle in unit B;

(b) valve I is adapted to open and valves J and/or K function to admit working liquid to the housing(s) if a pressure differential is detected in the primary and secondary working-liquid inlet lines at this point;

(c) valve I is adapted to close and the pressure-equalizing pump to shut off when equal pressures are detected in the primary and secondary working-liquid inlet lines;

(d) the discharging cycle in unit A now being over, in sequence, valves H and F are adapted to open, valve E to close, valve G to close, valve L, to open, and valve C to open, whereby the units have switched cycles with no change in flow rate;

(e) valves L and C are adapted to close, and the pressure-equalizing pump is adapted to be activated, when the filling cycle in unit A has been completed;

(f) valve I is adapted to open and valves J and/or K function to admit working liquid to the housing(s) if a pressure differential is detected in the primary and secondary working-liquid inlet lines at this point;

(g) valve I is adapted to close and the pressure-equalizing pump to shut off when equal pressures are detected in the primary and secondary working-liquid inlet lines;

(h) the discharging cycle in unit B now being over, in sequence, valves G and E are adapted to open, valve F to close, valve H to close, valve M to open, and valve D to open, whereby the units have again switched cycles with no change in flow rate.

6. A pump of claim 1 wherein the source from which said pressure-equalizing means derives its energy is a pump (29) in a secondary working-liquid inlet line (27).

* * * * *